United States Patent [19]

Cunningham, deceased

[11] 4,060,225

[45] Nov. 29, 1977

[54] WHEELBARROW WITH REMOVABLE MIXER

[75] Inventor: Art Cunningham, deceased, late of Pleasant Hill, Calif., by Velma Ruth Cunningham, executrix

[73] Assignee: Roger E. Bergman, Vallejo, Calif.

[21] Appl. No.: 672,088

[22] Filed: Mar. 31, 1976

[51] Int. Cl.[2] ..... B28C 5/14; B28C 5/42

[52] U.S. Cl. ..... 366/40; 366/46; 366/48

[58] Field of Search ..... 259/178 R, 161, 169, 259/72, 171, 179, 107, 109, 110; 280/47.31, 47.33

[56] References Cited

U.S. PATENT DOCUMENTS

| | | | |
|---|---|---|---|
| 873,455 | 12/1907 | Oelman | 259/178 R |
| 2,744,735 | 5/1956 | Selvage | 259/171 |
| 2,836,401 | 5/1958 | Phelan | 259/109 |
| 3,061,284 | 10/1962 | Tincher et al. | 259/178 R |
| 3,211,436 | 10/1965 | Butterfield | 259/178 R |
| 3,572,652 | 3/1971 | Hale | 259/178 R |
| 3,820,763 | 6/1974 | Questi, Sr. et al. | 259/178 R |

FOREIGN PATENT DOCUMENTS

| | | | |
|---|---|---|---|
| 674,487 | 10/1929 | France | 259/178 R |

*Primary Examiner*—Billy S. Taylor

*Attorney, Agent, or Firm*—Townsend and Townsend

[57] ABSTRACT

A wheelbarrow mounting a container having upright side and end walls includes a generally U-shaped, upwardly opening cutout in one of the end walls. A mixing unit can be mounted to the wheelbarrow by placing a mounting plate of the unit over the cutout. The mixing unit comprises an elongate shaft protruding through the mounting plate into the container and means for driving the shaft. A mixing blade defined by axially spaced first and second arms which are angularly offset with respect to each other and attached to the shaft adjacent the mounting plate and adjacent a free shaft end, respectively, is also provided. The first arm of the blade extends radially away from the shaft and the second arm extends radially and axially away from the free shaft end while a generally longitudinally extending, twisted blade section interconnects free ends of the first and second arms.

12 Claims, 3 Drawing Figures

WHEELBARROW WITH REMOVABLE MIXER

BACKGROUND OF THE INVENTION

At small and medium-sized construction sites it is frequently necessary to mix and transport relatively small amounts of concrete, mortar, gypsum and the like (hereinafter sometimes collectively referred to as "concrete") by mixing the granular base materials, e.g., cement, sand or aggregate with water. The resulting slurry must then be transported to the point of actual use.

In some instances, the mixing operation is done on the ground by forming the granular materials in a pile and pouring water thereover while the materials are manually mixed with a shovel or a similar instrument. This is a slow mixing process requiring a great deal of hand labor and is only economical when the quantity of concrete to be mixed is small. After the mixing, the mixed concrete slurry must be shoveled to the point of use or shoveled into a suitable conveying vehicle, such as a wheelbarrow, for example. For larger applications a separate concrete mixer is sometimes provided which mixes the materials with water to form the slurry. The slurry is then in turn transported to the point of use, frequently by pouring it from the mixer into wheelbarrows.

Although adequate mixing can be accomplished with these prior art methods, the task is relatively tedious. It requires that the concrete slurry be loaded from one container (or from the ground) into a wheelbarrow or the like which increases the labor, the time required for getting the concrete to the point of use and which is, therefore, relatively costly. Even in instances in which a separate concrete mixer is provided the mixer in itself represents a significant investment and is, therefore, costly. Moreover, it clutters up the construction site, it cannot be readily moved about the site to position it closest to the point of use for the concrete. Thus, even separate mixers can be relatively costly to operate.

Attempts have therefore been made to simplify the mixing and transportation of small to modest quantities of concrete as frequently used on small and medium-sized construction sites. U.S. Pat. No. 2,744,735, for example, discloses a combined wheelbarrow-concrete mixer in which the mixer and the drive motor therefor are mounted to the frame of the wheelbarrow beneath a receptacle or container for the concrete and the base materials to be used. Although this device eliminates the multiple transfer of the base materials and/or the mixed slurry from one container to another, the wheelbarrow is heavy and therefore difficult to handle. Moreover, each wheelbarrow is furnished with an entire mixing unit, including the drive therefor which renders it expensive. The cost, coupled with the cumbersome handling of such wheelbarrows significantly detracts from their utility and, as far as is known they have never been commercially accepted.

U.S. Pat. No. 3,820,763 seeks to overcome some of the shortcomings of the above-referenced patent by mounting the concrete mixing unit to a retractable overhead arm which is permanently mounted to a suitable support surface such as the ground. In that patent, the mixing unit depends vertically into the container of a wheelbarrow or the like which is positioned beneath the overhead arm while a rotatable mixing blade is lowered into the container for mixing the concrete. The structure disclosed in this patent eliminates the earlier discussed handling problems of the wheelbarrow due to an excessive deadweight. However, the device is essentially stationary and rather complicated. It requires upright mounting posts which permit vertical travel of the overhead arm to clear the wheelbarrow, multiple joints, linear slide ways, etc., all of which greatly increases the cost of the device.

The following additional U.S. patents disclose a variety of portable mixing apparatus which are considered relevant to the present invention: U.S. Pat. Nos. 1,051,003; 1,161,363; 2,597,688; 3,061,284; 3,185,451; 3,211,436; and 3,450,392.

All of these patents disclose a variety of mixer constructions which have multiple drawbacks so that they have never become accepted to any appreciable extent. Accordingly, there is presently a need for lightweight, inexpensive and portable apparatus which simplifies the concrete mixing operation as well as the delivery of the mixed concrete to its point of use.

SUMMARY OF THE INVENTION

Generally speaking, the present invention provides a wheelbarrow which can be used for both mixing and transporting concrete and similar cementitious or granular slurries (such as gypsum slurries, mortar, etc.). For the purposes of this specification and the claims the term "concrete" includes and is intended to include such other cementitious or granular slurries unless otherwise indicated.

The wheelbarrow includes a support frame and an elongate container carried by the frame and having relatively longer sides and relatively shorter end walls which interconnect the sides of the container. The frame includes a pair of spaced apart handles protruding in a rearward direction and the aft end wall includes an upwardly open, U-shaped cutout extending from an uppermost edge of the aft end wall in a generally downward direction.

A mixing unit having a mounting plate drive means and a shaft protruding from the drive means and mounting a mixing blade for rotation with the shaft is provided. The mounting plate is secured to the drive means and forms a gap between opposing sides of the drive means and the plate, respectively, which has a sufficient width to accommodate therein the container end wall so that the mounting plate can be placed over the U-shaped cutout in the end wall while the drive means is disposed outside the container. The mounting plate has a length and width greater than the corresponding length and width of the cutout so as to completely overlie and close it. The upper edge of the mounting plate is defined by a downwardly open channel member disposed on the side of the plate facing the drive means so that the mounting plate securely engages the end wall of the container and mounts and supports the blade and the drive unit thereon. The need for exterior support arms, posts and the like as were necessary with some prior art devices, are thus eliminated.

To facilitate the mixing and induce a circulatory motion to the slurry in the container, the blade is defined by axially spaced pairs of first and second arms which are angularly offset with respect to each other and attached to the shaft adjacent the mounting plate and adjacent a free end of the shaft, respectively. The first arm pair extends radially away from the shaft while the second arm pair, adjacent the free shaft end, extends radially and axially away therefrom. A pair of generally longitudinally extending twisted blade section interconnects free ends of the first and second arm pairs. When the blade is rotated the twisted blade sections induce a motion to the slurry which is generally parallel to the shaft and transverse to the direction of rotation of the blade. This, in turn, results in a longitudinal circulatory motion of the slurry which greatly facilitates the mixing action. The circulatory slurry motion is further enhanced by constructing the container generally semi-circular with the blade axis forming the center of the container.

A water supply conduit including a water shut-off valve is attached to the drive means and the mounting plate and is positioned so that when the valve is opened, water can be directed into the container. This facilitates the mixing operation because the need to carry water in separate containers, or the need for a separate water supply hose which can easily become entangled and damaged on a construction site are eliminated.

The mixing unit is relatively lightweight, comprising no more than a blade, a shaft for the blade and a relatively small drive unit such as an electric motor and the necessary gearing. Complicated rigid mounting mechanisms, posts, arms, joints and the like are eliminated. Consequently, the mixing unit of the present invention is readily manipulated by a single workman.

To mix a batch of concrete the mixing unit is simply lifted into place by aligning the mounting plate and its downwardly opening channel with the cutout in the end wall of the wheelbarrow container. The unit is then dropped downwardly until the channel engages the upper edge of the end wall and supports the unit and, in particular, the mixing blade in the desired position. Thereafter, the drive means is energized. After completion of the mixing operation the unit is lifted from the wheelbarrow and is available for immediate use to mix a new batch in the next wheelbarrow. The just finish mixed batch is already in the wheelbarrow and can be immediately wheeled to the point of use without the need for reloading it.

As a consequence, the mixing and transportation of concrete on a construction site is speeded up while labor costs are greatly reduced. This is accomplished without increasing the cost or maneuverability of the wheelbarrow. Accordingly, the present invention is a substantial advance over the prior art.

DESCRIPTION OF THE PREFERRED EMBODIMENTS

Figure 1:
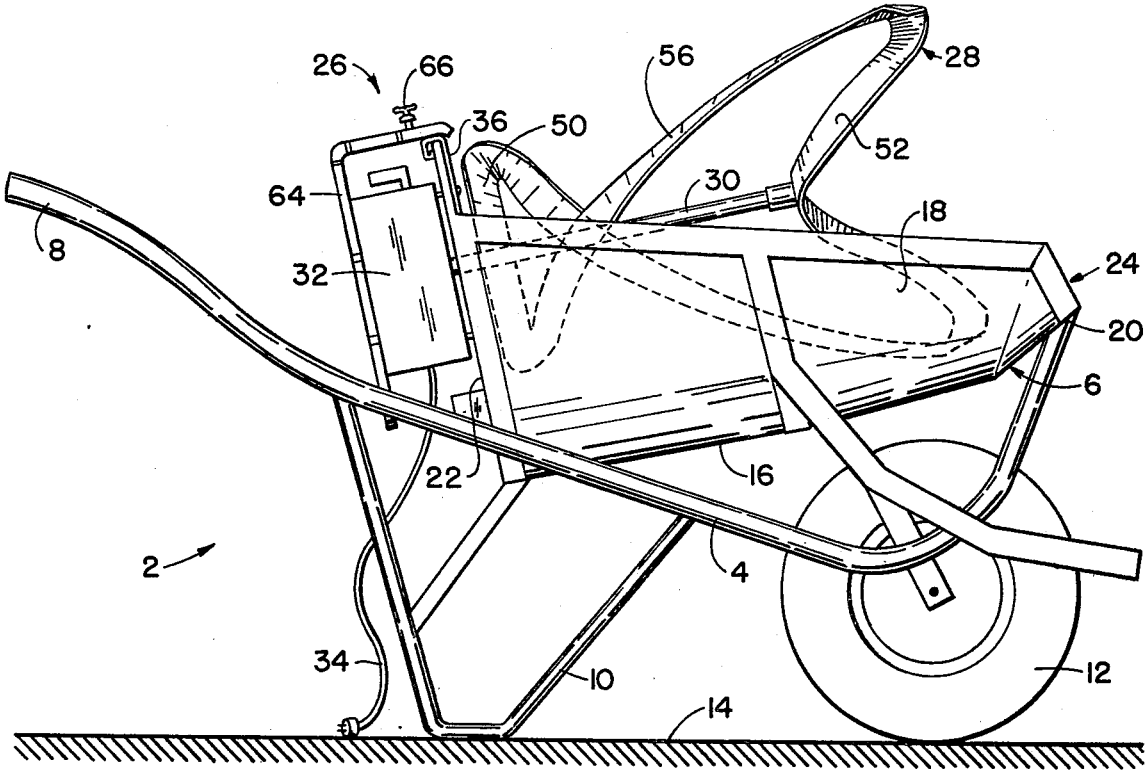
FIG. 1 is a side elevational view of a wheelbarrow-mixing unit constructed in accordance with the present invention.
Figure 2:
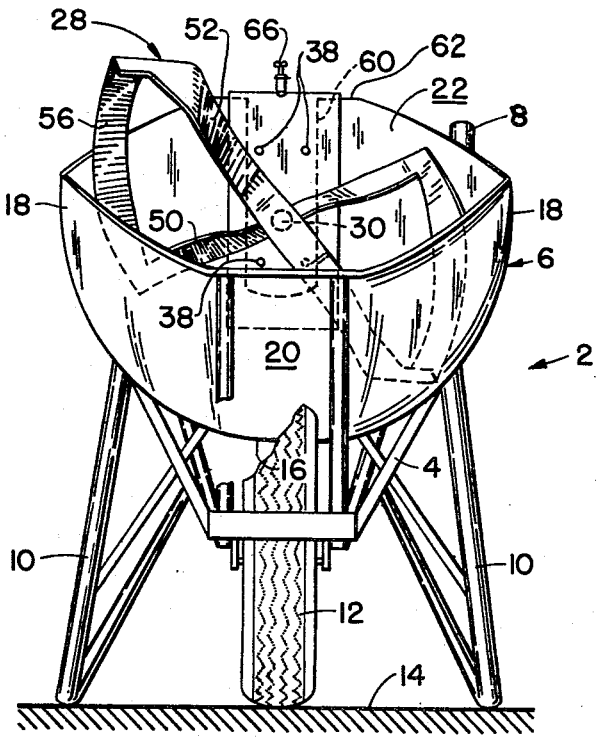
FIG. 2 is a front elevational view of the wheelbarrow-mixing unit shown in FIG. 1.

Referring to the drawings, a wheelbarrow-concrete mixing unit constructed in accordance with the present invention broadly comprises a wheelbarrow 2 including a support frame 4 and, mounted thereto, a receptacle or container 6 for holding a quantity of a granular slurry such as concrete, mortar, gypsum or the like. The frame includes a pair of spaced apart, rearwardly extending handles 8, support pedestals 10 and further mounts a wheel 12 adjacent the forward end of the frame so that the wheelbarrow can be rolled about a support surface 14.

Container 6 is generally defined by a floor or bottom 16, a pair of laterally spaced, longitudinally extending side walls 18 and opposite front and aft end walls 20, 22, respectively which interconnect the ends of side walls 18. It is presently preferred that the container floor 16 and side walls 18 form an arcuate, generally semi-circular bucket without pronounced edges and substantially concentric with the axis of the mixing blade discussed below, to facilitate a complete and thorough mixing operation. Preferably, side walls 18 extend to about the axis of the mixing blade to prevent an accidental spilling of the slurry being mixed. The forward end wall 20 preferably defines a discharge chute 24 so that concrete in the wheelbarrow can be dumped by lifting handles 8 and pivoting the frame about the axis of wheel 12 in a well-known manner.

A mixing unit 26 is mounted to aft end wall 22 and generally comprises a mixing blade 28 mounted to a shaft 30 protruding in a forward direction from a drive mechanism 32. The drive mechanism includes a motor, preferably an electric motor, but it may also be an internal combustion engine, for example, suitable gearing (not separately shown) and an electric cord 34 for connecting the motor with an energy source (not separately shown). A mounting plate 36 is secured to drive mechanism 32 with a plurality of bolts 38 and is spaced therefrom by tubular spacers 40 or the like disposed between opposing sides 42, 44 of the mounting plate of the drive mechanism, respectively. A gap 46 is thus defined between the plate and the drive which has a width slightly greater than the thickness of wheelbarrow container end wall 22 for purposes more fully described hereinafter. The upper end of the mounting plate further defines a downwardly opening channel member 48 which is disposed on the side 42 of the plate facing the drive mechanism.

Figure 3:
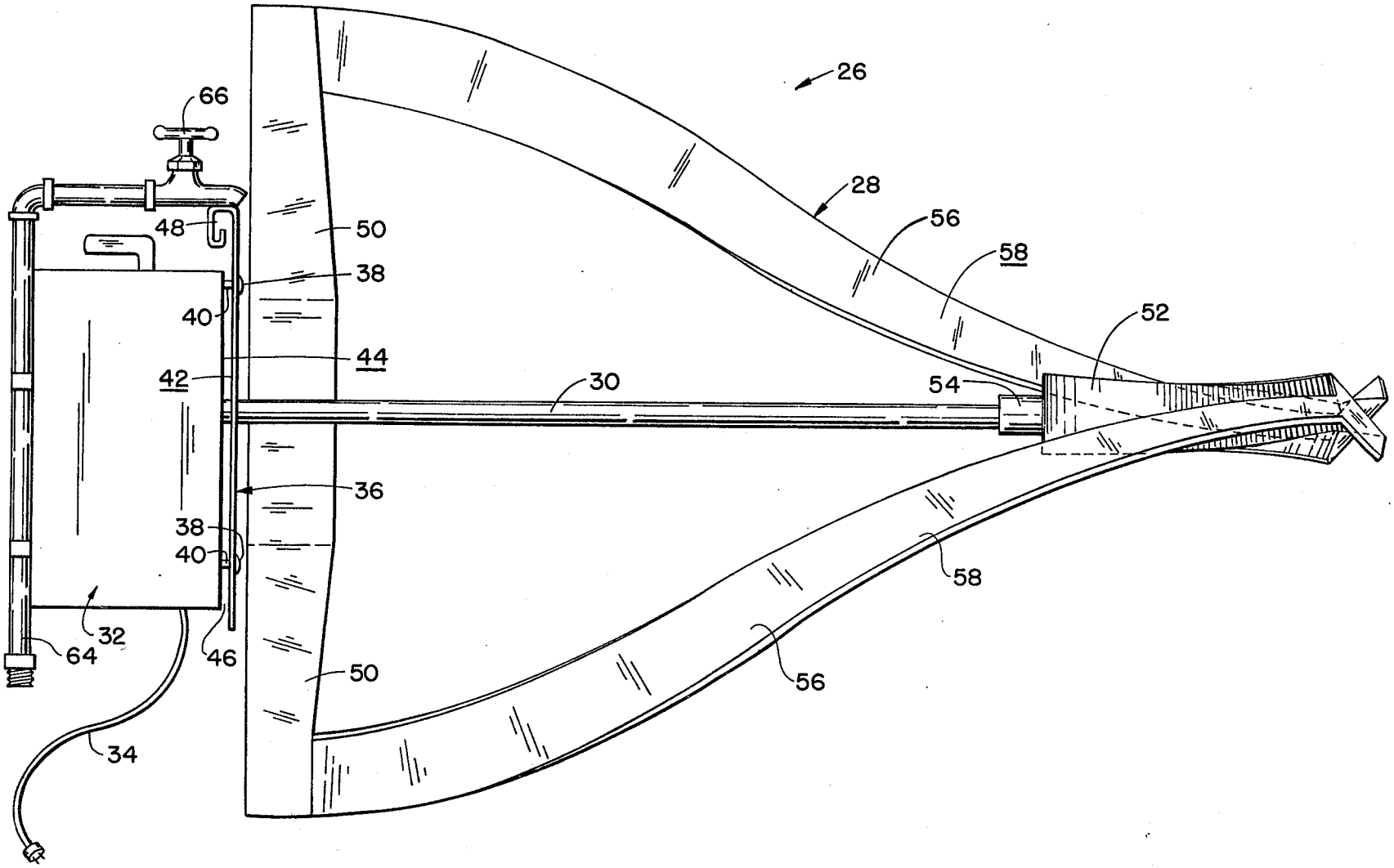
FIG. 3 is an enlarged, side elevational view of the mixing unit of the present invention and illustrates in greater detail the construction of the mixing blade.

Blade 28 is defined by a pair of first blade arms 50 secured, e.g., welded to the shaft adjacent mounting plate 36 and protruding radially away from the shaft. A second pair of blade arms 52 is secured, e.g., welded to a sleeve 54 mounted, e.g, bolted to a free end of the shaft 30. The second blade arms are angularly offset with respect to the first arms, preferably by about 90°, and they too protrude radially away from the shaft. In addition, they extend in a generally forward direction (to the right as viewed in FIG. 3). Twisted blade sections 56 extend between and are secured, e.g., welded to the free ends of the first and second blade arms 50, 52. As can best be seen from FIG. 3, the blade sections extend in a longitudinal direction, that is, in the general direction of shaft 30 and they are compoundly curved into a generally twisted shape so that the ends of each side 58 of each blade are perpendicular with respect to each other.

The use and operation of the wheelbarrow-mixing unit of the present invention should now be apparent. To briefly summarize it, mixing unit 26 is normally removed from the wheelbarrow. When a batch of concrete is to be mixed the mixing unit is picked up and gap 46 between mounting plate 36 and drive mechanism 32 is aligned with aft end wall 22 while the mounting plate itself is aligned with a generally U-shaped, upwardly open cutout 60 in the aft end wall which extends from an upper edge 62 of the end wall in a downward direction. Thereafter, the mixing unit is dropped down so that shaft 30 as well as spacers 40 are disposed within cutout 60. It will be observed that mounting plate 36 has a length and width greater than the length and width of the cutout to completely cover the cutout.

Channel member 48 of mounting plate 36 engages the upper edge 62 of aft wall 22 and supports the mixing unit on the container 6 while it properly positions blade 28 in the container. The channel member is located so that the outermost portion of the mixing blade is spaced from but relatively closely adjacent to the curved container floor and side walls 16, 18. Cement, sand, aggregate and the like is now placed in container 6 for admixture with water to form a concrete slurry.

To facilitate the addition of water, a water supply pipe 64 including a shut-off valve 66 is mounted to the backside of drive unit 32 and to channel 48 of mounting plate 36. The end of the supply pipe is normally connected to a water supply hose (not separately shown) and before the drive unit is energized valve 66 is opened to flow the desired quantity of water into container 6. Thereafter the drive unit is energized so that shaft 30 rotates blade 28, thereby intimately mixing the water with the sand, cement, etc.

It will be noted that by virtue of the angular offset of arms 50, 52 and the resulting longitudinal twist of blade section 56 slurry contacted by the blade section is forced in a generally forward direction. This induces a forward circulation of the slurry along side walls 18 of the container and a resulting return of the circulating slurry along the center of the container. The semi-circular shape of the side walls and the bottom of the container further enhances this slurry circulation. A more intimate and efficient mixing action is thereby obtained.

After the concrete slurry has been completely mixed the drive mechanism 32 is de-energized and mixing unit 26 is lifted from the wheelbarrow for use with another like wheelbarrow. A cover plate (not separately shown) constructed identically to mounting plate 36 (except that it does not have holes for shaft 30 and bolts 38) can be placed over cutout 60 to prevent concrete slurry from spilling through the cutout.

It is claimed:

1. Apparatus for mixing and transporting a cementitious slurry comprising in combination: a container including upwardly inclined sidewalls for receiving slurry materials including water and means mounting the container for movement over a support surface; a mixing unit including a mixing blade being at least partially disposed in the container and drive means including a shaft for rotating the blade; and means for removably mounting the mixing unit to and supporting the unit on an end wall of the container so that slurry materials in the container are intimately mixed by the blade when the drive means is actuated, the mounting means including a mounting plate to which the drive means is secured and through which the shaft extends, the plate including a U-shaped upper end defining a downwardly opening channel for engaging an upper edge of the end wall during the mixing operation; whereby the slurry can be mixed in the container by temporarily positioning the mixing unit thereon and thereafter removing it for movement of the mixed slurry in the container to a point of use.

2. Apparatus according to claim 1 wherein the blade includes a blade portion extending from adjacent the end wall towards another end of the container, the blade portion having a curved configuration imparting to the slurry materials in the container a movement having a component in the direction of the container length.

3. Apparatus according to claim 1 including means mounted to the mixing unit for supplying water to the container.

4. Apparatus for mixing and transporting a concrete slurry comprising in combination at least one wheelbarrow including a container for holding a quantity of the slurry during mixing and transport thereof, the container having elongate sides and an end wall; a mixing unit for agitating and mixing a slurry in the container, the unit having an elongate mixing blade, a shaft mounting the blade, drive means for rotating the shaft about its axis, and means for mounting the mixing unit to the end wall so that the blade extends longitudinal of the container, the mounting means including a mounting plate to which the drive means is secured and through which the shaft extends, the plate including a U-shaped upper end defining a downwardly opening channel for engaging an upper edge of the end wall during the mixing operation, the blade having a curved configuration imparting to particles contacted by it while it rotates about the axis of the shaft a travel component in the direction of the container length so that the slurry circulates longitudinally in the container while the drive means is energized; whereby the slurry can be mixed in the container with the mixing unit and the mixing unit can be removed therefrom for transport of the mixed slurry to a point of use while the mixing unit can be used to mix a slurry in another container.

5. Apparatus according to claim 4 wherein the end wall includes a generally U-shaped cutout extending from the upper end wall edge in a downward direction, and wherein the mounting plate has a width and a length greater than the cutout, and wherein the U-shaped channel is disposed on the side of the mounting plate facing away from the mixing blade so that the mounting plate covers the cutout during the mixing operation.

6. Apparatus according to claim 4 including a water supply conduit having a water shut-off valve mounted to the mounting plate for supplying the container with water when the mixing unit is mounted to the end wall.

7. Apparatus according to claim 4 wherein the mixing blade has first and second generally radially oriented members secured to the shaft adjacent a free shaft end and the mounting means, respectively, and an interconnecting, longitudinally twisted blade section interconnecting free ends of the radial members.

8. Apparatus according to claim 7 wherein the radial members are angularly offset with respect to each other, and wherein the member disposed adjacent the free shaft end extends in a radial and axial direction away from the free shaft end.

9. A wheelbarrow for mixing and transporting concrete and like cementitious slurries comprising in combination:

an elongate container including relatively long sides and relatively short end walls interconnecting the sides, and means mounting the container for movement about a support surface, an end wall of the container including an upwardly open cutout extending from an uppermost edge of the end in a downward direction;

a mixing unit having a blade, drive means, and a shaft protruding from the drive means and mounting the blade for rotation with the shaft;

a mounting plate for mounting the unit to the container end wall, the mounting plate having a length and a width greater than the corresponding length and width of the cutout so as to completely overlie the cutout and close it, an upper edge of the mounting plate including a downwardly open U-shaped member disposed on the side of the mounting plate facing away from the blade;

means securing the mounting plate to the drive means and forming a gap between opposing sides of the drive means and the plate, respectively, the gap having a sufficient width to accommodate therein the container end wall;

a water supply conduit including a water shut-off valve attached to at least one of the drive units and the mounting plate for supplying water to the container when the mounting plate overlies the cutout;

the blade being defined by axially spaced first and second arms which are angularly offset with respect to each other and attached to the shaft adjacent the mounting plate and adjacent a free shaft end, respectively, the first arm extending radially away from the shaft and the second arm extending radially and axially away from the free shaft end, and a generally longitudinally extended, twisted blade section interconnecting free ends of the first and second arms;

whereby the slurry can be mixed in the container by placing the U-shaped member over the end so that the mounting plate overlies the cutout and the container end wall is disposed in the gap, whereby water required during the mixing operation is directly supplied to the materials in the container from the water conduit and the rotation of the blades imparts to the slurry in the container a circulatory motion generally parallel to the shaft and transverse to the direction of rotation of the blades.

10. A wheelbarrow according to claim 9 wherein the container includes a container bottom, the side walls and the bottom defining a substantially continuous, arcuate interior container surface.

11. A wheelbarrow according to claim 10 wherein the arcuate container surface is semi-circular and substantially concentric with shaft of the mixing unit.

12. A wheelbarrow according to claim 11 wherein at least a portion of the container surface extends above the shaft axis.

* * * * *